United States Patent [19]

Windischbauer

[11] Patent Number: 4,630,651

[45] **Date of Patent: * Dec. 23, 1986**

[54] APPARATUS FOR THE CONSTRAINED ACTUATION OF THE CLAMPING SYSTEM OF FILLING-YARN INSERTION DEVICES IN SHUTTLELESS WEAVING MACHINES

[75] Inventor: Florian Windischbauer, Lindau, Fed. Rep. of Germany

[73] Assignee: Aktiengesellschaft Adolph Saurer, Arbon, Switzerland

[ * ] Notice: The portion of the term of this patent subsequent to May 7, 2002 has been disclaimed.

[21] Appl. No.: 698,396

[22] Filed: Feb. 5, 1985

Related U.S. Application Data

[63] Continuation-in-part of Ser. No. 510,833, Jul. 5, 1983, Pat. No. 4,515,185.

[30] Foreign Application Priority Data

Jul. 2, 1982 [DE] Fed. Rep. of Germany ..... 3224708

[51] Int. Cl.[4] ..... D03D 47/18

[52] U.S. Cl. ..... 139/446

[58] Field of Search ..... 139/446, 443, 444, 445, 139/450

[56] References Cited

U.S. PATENT DOCUMENTS

| | | | |
|---|---|---|---|
| 2,749,946 | 6/1956 | Pfarrwaller | 139/450 |
| 2,954,056 | 9/1960 | Whewell | 139/450 |
| 3,438,402 | 4/1969 | Kokkinis | 139/446 |
| 4,515,185 | 5/1985 | Windischbauer | 139/446 |

FOREIGN PATENT DOCUMENTS

| | | | |
|---|---|---|---|
| 3224708 | 1/1984 | Fed. Rep. of Germany | 139/446 |

*Primary Examiner*—Henry S. Jaudon

*Attorney, Agent, or Firm*—Werner W. Kleeman

[57] ABSTRACT

A shuttleless weaving machine employs filling-yarn transfer at the center of a shed from a first gripper system advanced from one side to a second gripper system approaching from the other side. The yarn transfer is implemented by opening and subsequently closing the clamping means of the gripper systems by means of control levers which are made to enter from the outside through the warp threads into the shed. The control levers are mounted at fixed locations and are so shaped and can be so pivoted from an operational position within the shed into a rest position below the shed that, when the reed beats up, the reed stay can pass unhindered over the control levers.

10 Claims, 2 Drawing Figures

APPARATUS FOR THE CONSTRAINED ACTUATION OF THE CLAMPING SYSTEM OF FILLING-YARN INSERTION DEVICES IN SHUTTLELESS WEAVING MACHINES

CROSS REFERENCE TO RELATED APPLICATION

This application is a continuation-in-part application of my related copending U.S. application Ser. No. 06/510,833, filed July 5, 1983 now U.S. Pat. No. 4,515,185, and entitled "Apparatus for the Constrained Actuation of the Clamping System of Filling-Yarn Insertion Devices in Shuttleless Weaving Machines".

BACKGROUND OF THE INVENTION

The present invention broadly relates to weaving machines and, more specifically, pertains to a new and improved construction of an apparatus used in shuttleless weaving machines where the filling insertion takes place on one side by means of gripper systems provided with clamping means for the filling-yarn or weft thread and which are advanced into the shed and then retracted.

Generally speaking, the apparatus of the present invention is employed in a shuttleless weaving machine wherein filling-in yarn or weft thread is inserted by gripper systems which are bilaterally advanced into the shed and then retracted and which are provided with clamping means for the filling-yarn. Control means are arranged laterally of the weaving machine for processing ends of the filling-yarn before and after insertion thereof into the shed, for constrained actuation of the clamping means by control levers controlled by cam means and entering through the warp threads of the shed from the exterior.

Such a weaving machine is known, for instance, from German Pat. No. 1,710,292, granted Aug. 30, 1973. In this patent, the filling-yarn is seized by the clamping means of a gripper system when outside of the shed and is transported by the gripper system to the approximate shed center. There, the filling is transferred to the clamping means of a gripper system advanced from the opposite side which, upon retraction, pulls the filling-yarn entirely through the shed. The yarn transfer at the center of the shed takes place while the participating clamping means are controlled in a constrained manner in such a way as to provide a brief time during which control levers pass through the shed's warp threads to open and then again close the clamping means. The actuation of the control levers is coupled to the main drive for the weaving machine and takes place not only when the filling-yarn is transferred in the shed's center, but also can be used when seizing and releasing the filling-yarn outside of the shed.

The control system is designed in such a manner that the control lever is pivotably supported on the end of arms which themselves are rigidly seated on the sley shaft and accordingly carry out a pivoting motion together with the sley during the beating-up of a filling-yarn. A pivot lever acting as a support for sensor rolls is furthermore rotatably seated on the sley shaft, where the sensor rolls rest under spring loading against a cam. The cam is mounted on a special, continuously rotating side shaft parallel to the sley shaft. The connection between the control lever and the pivot lever is provided by a connecting rod. This continuously rotating side shaft rotating at 1:1 is parallel to the main shaft ensuring the power transmission of the reed and gripper drive from one side of the weaving machine to the other and advantageously rotates, for instance, in the ratio of 3:1 or 4:1. However, the geometry of weaving machines permits only a limited space for mounting and sizing the main shaft, the side shaft with cams and the sley shaft. In particular, it is impossible to select the cams so as to possess a sufficiently large size.

When beating-up, each above-mentioned arm not only carries along the control lever, but it furthermore, by means of a stop and driver, rotates the pivot lever, whereby the sensing roll is lifted from the cam. The spacing between the stop and the driver must be precisely set in order to achieve the proper motion of the control lever during reed beat-up.

It is characteristic of this equipment that at higher operating speeds of the weaving machine, the rolls no longer intimately follow the cam profile or cam bearing surface but lift off it and tend to bounce. As a result, they will also lift off in undesired manner from the control cam profile or surface against which they are supposed to bear in relation to the desired control curve. Because the control levers follow, via the connecting rod, the motion of the rolls, i.e., the motions of the pivot lever, the clamping means at the gripper systems may be spuriously actuated. Therefore, flawless filling-yarn transfer from one gripper system to the other is no longer assured in such a case. Moreover, the bouncing and reseating of the rolls greatly stresses, and possibly damages, the cam bearing surfaces.

German Pat. No. 2,934,474, granted June 11, 1981, and corresponding to the U.S. Pat. No. 4,384,598, granted May 24, 1983, describes a modified apparatus. In this apparatus, the pivot lever sensing the cam motion is rotatably supported but fixed to the machine outside the sley shaft. This design averts the above-cited difficulties and even at high operating speeds of the weaving machine, improved yarn transfer is achieved. In this design, the center of rotation of the pivot lever for driving the connecting rod and the control lever no longer is situated in the sley shaft and the roll no longer lifts off of the cam but, on the contrary, the rolls always remain on the cam's control curve. Furthermore, it is no longer necessary as previously to precisely set the costly and highly stressed bearing surface at the stop and driver. Moreover, an improved arrangement of the return spring is possible at the pivot lever, and no interfering inertial forces arise at the spring during reed beat-up.

Nevertheless, a further factor adversely affects both of the known apparatuses. This factor is that the control lever is mounted on the end of a special arm and, upon reed beat-up, is pivoted together with this arm out of the shed and back in addition to its own control motion. The number of required individual parts and bearing locations or joints results in a not insignificant amount of play. Due to the vibrations of the arms and of the control lever due to the brusque stopping motion of the reed, this play becomes noticeable at the control site, that is, at the end of the control lever, and may impair the control function.

Additionally, another problem arises. It has been noted in practice that at higher operating speeds of the weaving machine, the uncontrolled vibrations arising at the control parts due to the inertial forces exceed by far the actually required control force. Consequently, in these known designs, the springs of the cam sensor means always must be highly tightened. The high spring force results in excessive wear and furthermore constitutes an impediment when the weaving machine must be turned by hand.

SUMMARY OF THE INVENTION

Therefore, with the foregoing in mind, it is a primary object of the present invention to provide a new and improved construction of an apparatus for constrained actuation of clamping means in a shuttleless weaving machine which does not exhibit the aforementioned drawbacks and shortcomings of the prior art constructions.

Another and more specific object of the present invention aims at providing a new and improved construction of an apparatus for constrained actuation of clamping means in a shuttleless weaving machine which so improves the operation of the foregoing equipment that the tendency to vibrate is further reduced and that overall there will be little play in the individual parts, whereby it is possible to achieve higher operating speeds of the weaving machine with more reliability in filling-yarn pick-up or transfer by the gripper systems, and hence improves the efficiency thereof, and moreover the special side shaft and the therewith related and above-cited drawbacks are eliminated.

Yet a further significant object of the present invention aims at providing a new and improved construction of an apparatus for constrained actuation of clamping means in a shuttleless weaving machine of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the improved apparatus of the present invention is manifested by the features that it comprises: pivot means defining a pivot axis for pivotably mounting the control levers at a fixed location below a path of travel of a fabric being woven in the weaving machine; a control shaft extending beneath the path of travel of the fabric and substantially parallel to the pivot axis; the cam means comprising at least one mutually complementary cam wheel pair mounted on the control shaft in driven relationship thereto; actuation means comprising at least one double-lever rocker arm, sensing rolls cooperating therewith for operatively following the cam means and rocking means defining a rocking axis extending substantially parallel to the control shaft for pivotably mounting the double-lever rocker arm; the cam means and the actuating means conjointly defining a constrained-control cam system; and linkage means operatively connecting the control levers with the actuation means for pivoting the control levers out of an operative position entering the shed into an idle position beneath a path of motion of a reed stay of a reed of the weaving machine.

Advantageously, the cam means are mounted on a conventional cam shaft extending substantially horizontally beneath the fabric, controlling the devices provided on both sides of the weaving machine and processing the ends of the filling-yarns or weft threads before and/or after the insertion of the filling. In this manner, the special 1:1 side shaft required in the known equipment is eliminated; hence both the main shaft and the sley shaft can be designed to meet the particular requirements without restriction. Vibrating or oscillating levers and cams are now eliminated in the vertical region between the main shaft and the sley shaft and space is available for a sufficiently large tubular reed shaft. Gearing to drive the reed is now required on only one side of the weaving machine. The one-sided reed drive with a large reed shaft provides dynamic behavior of the reed at high angular speeds which is improved in comparison to the previously conventional double drive since a double drive prevents perfect synchronization of both sides of the weaving machine, leading to reed vibrations in beating-up. Such vibrations cause additional wear in the gripper systems which are guided by the reed and may impair the transfer of the filling-yarn and cause weaving defects. These drawbacks are remedied by the present invention. Furthermore, a one-sided reed drive represents a saving in transmission components and hence an appreciable reduction in costs.

Because the special arm on the sley shaft is eliminated and because the control lever is held by a spatially fixed bearing, both the tendency to vibrate due to the reed beat-up and the special pivot levers and the long connecting rod are entirely eliminated and now the entire apparatus can be mounted compactly between the fabric and upper crossbeam connecting the two sides of the weaving machine frame. Long control bars and a substantial number of play-incurring bearings are no longer required. Because of the constrained cam control, for instance by double eccentrics or mutually complementary cam wheel pairs or disk pairs, the difficulties caused by return springs also are prevented. As a whole, the invention not only provides more reliability in the control function and a higher operating speed of the weaving machine, but also a reduction of the manufacturing costs and decreased maintenance expenses, because due to the smaller number of individual parts less wear takes place.

Since the control lever is no longer coupled to the reed and is no longer moved together with the reed out of the shed but, rather, is moved into a rest or idle position prior to beating-up and the reed is displaceable above the control lever in its rest or idle position, the control lever is advantageously bent into such a shape that, in its rest or idle position, its upper boundary or profile is substantially fitted to, or conforms to, the lower contour or profile of the reed.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
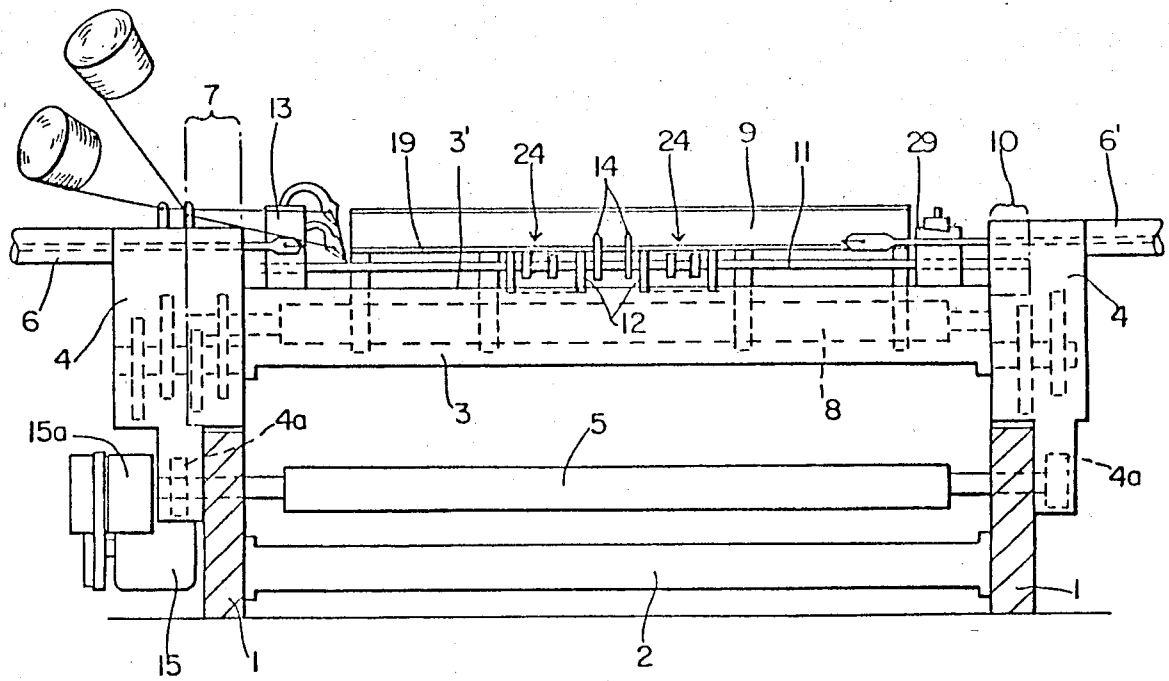
FIG. 1 is a schematic view of the control system mounted on a weaving machine.

Describing now the drawings, it is to be understood that to simplify the showing thereof only enough of the structure of the apparatus for constrained actuation of clamping means in a shuttleless weaving machine has been illustrated therein as is needed to enable one skilled in the art to readily understand the underlying principles and concepts of this invention. Turning now specifically to FIG. 1 of the drawings, this figure schematically shows the most important parts of a weaving machine as viewed from the front. This is a weaving machine with filling insertion, for instance by rigid gripper bars advanced from both sides into the shed and inserting the filling or weft from the left side, transferring it to another gripper at the center of the shed, and drawing it out toward the right side of the machine. The side walls 1 are indicated as the support components for the weaving machine; they are connected together by a lower crossbeam 2 and an upper crossbeam 3.

A main drive motor 15 with a connected electromagnetic clutch/brake device 15*a* is mounted on the left side wall 1. From there, the drive passes through the transmission stages 4*a* to the main transmission 4 from which is tapped, for instance, the gripper drive and so forth. A main shaft 5 provides the synchronization of the main transmission 4 on the left and right sides of the machine. The main shaft 5 rotates, for instance, in the ratio of 3:1 or 4:1, depending upon the design of the two transmission stages 4*a* on the left and right sides of the machine in order that there be a speed ratio of 1:1.

A transmission part 7 driving the sley shaft 8 is powered from the main transmission 4 on the left side of the weaving machine. Arms, not designated further, are seated on the sley shaft 8 and support the reed stay 19 and the reed 9 mounted thereon. The main shaft 5 and the sley shaft 8 are, in this instance, designed as tubular shafts. The transmission part 7 in this illustration is required on one side only of the weaving machine because a tubular shaft 8 is used.

The overall operation of the invention will now be described. The gripper bars for inserting the filling-yarn or weft thread are indicated above the gears 4 and designated by the reference characters 6 and 6'. The filling-yarn is withdrawn from supply spools, not designated further and located on the left side of the weaving machine, and is advanced by a filling-yarn insertion means or donor device 13 of the left gripper bar 6 and seized by its clamping means to insert the filling. During insertion, the left gripper 6, in its function as the donor gripper, moves the filling-yarn approximately into the center of the shed where it transfers it to the acceptor gripper 6', which was also advanced to that location from the right side.

In the process, the control levers 14 are consecutively actuated to transfer the filling-yarn from the clamping means of the left gripper 6 to the clamping means of the right gripper 6'. When the gripper bars are retracted, the filling-yarn is pulled out of the shed toward the right and is taken off by a yarn pick-up device schematically indicated at 29.

The motions of the various components participating in filling-yarn insertion, for instance of the donor device 13, of the yarn pick-up device 29 or of other parts not shown, for instance filling-yarn shears, filling-yarn lay-in device, etc., are powered from a control shaft 11 passing above the upper crossbeam 3 from one side to the other of the weaving machine. The transmission 10 for the control shaft 11 is provided on one side only of the machine and effects a 1:1 drive. In the invention, this control shaft 11 also drives the control levers 14, and therefore also drives their control or actuating parts or cams 28.

Figure 2:
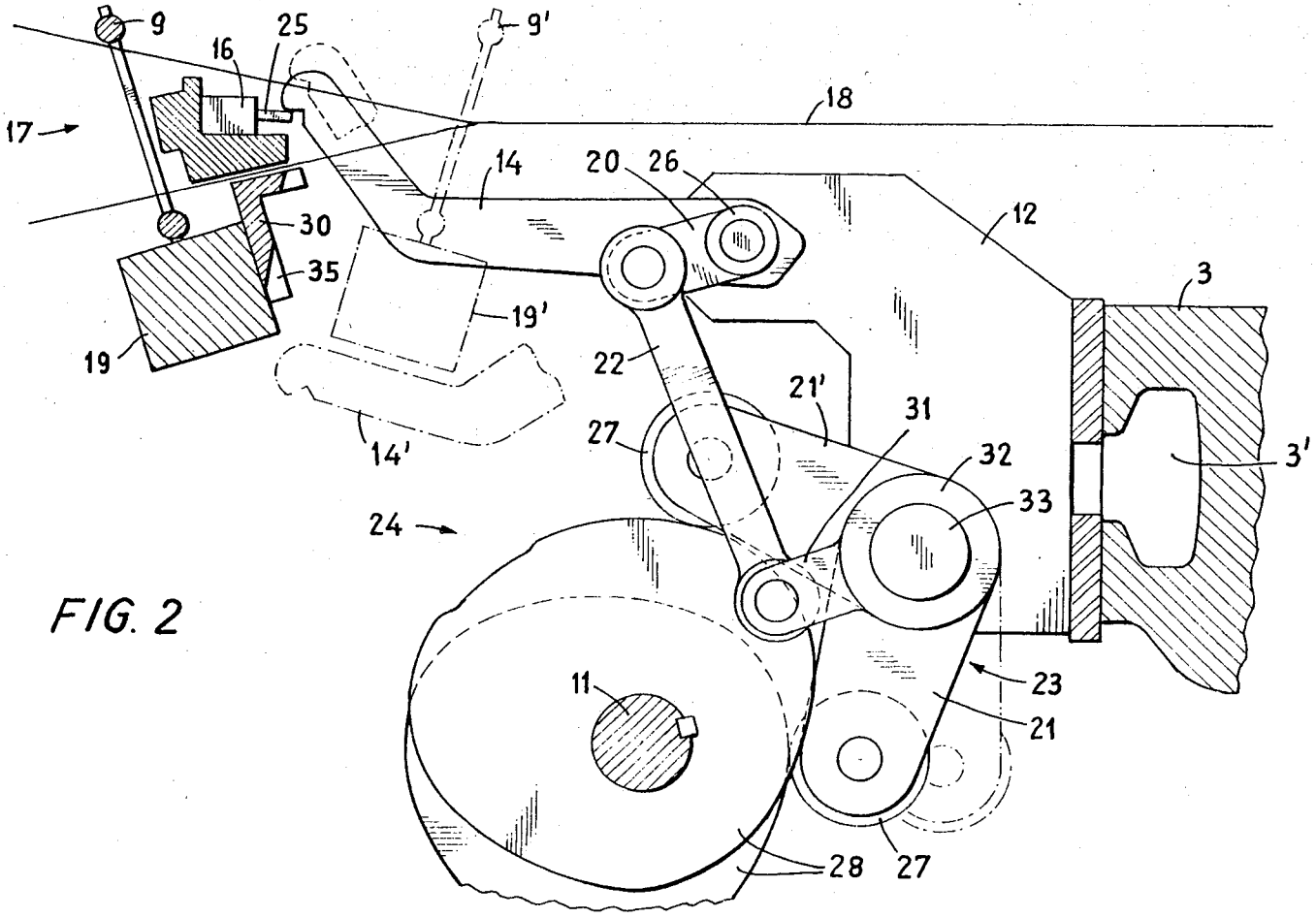
FIG. 2 is a view in cross-section of a preferred embodiment of the control system with the control levers and cams mounted separately.

Details of the control system are shown in FIG. 2. The control levers 14 are mounted on blocks 12 displaceable along the crossbeam 3. The upper crossbeam 3 is provided with a groove 3' in which the blocks 12 can be displaced and tightened, for instance by screws. The blocks 12 and the control shaft 11 are located below the fabric path 18. A control lever 14 is rotatably supported in a pivot bearing 26. The control lever 14 has a gooseneck shape. Its free end, when in the operative position shown in solid lines in FIG. 2, passes through the warp threads from beneath and in the form of a finger into the shed 17 where it comes to rest against an actuating lever 25 for the gripper clamp. The reed 9 is shown in the shed and is supported by the reed stay 19. The actuating system 16 of for instance the gripper 6 moves the filling-yarn as shown into the shed; the above-cited actuation lever 25 for the clamping means at the gripper projects sideways to the right from the illustrated one of two actuating systems 16 which are associated with the left gripper 6 and the right gripper 6'.

To open the clamping means, the end of the control lever 14 presses the actuation lever 25 by means of a slight pivoting motion from the upper position shown in dotted lines to the operational position shown in solid lines. The clamping means is thereby briefly opened for yarn transfer.

To close the clamping means, the control lever 14 rises again into the upper position shown in dotted lines. When the clamping means is actuated, each of the actuating systems 16 rest on the reed 9 and also against a guide strip 30 mounted to the reed stay 19.

After the yarn has been transferred from the donor to the acceptor gripper, both actuating systems 16 are retracted. Subsequently, the control lever 14 can be immediately moved by cam control out of the shed 17 and can be pivoted into its rest or idle position 14', shown in dash-dot lines, and downwardly to such an extent that during reed beat-up the reed stay 19 can be moved into its position 19' and the reed into the operative position 9', without being hampered by the control lever 14. The stop motion of the reed stay from the position 19 into position 19' takes place above the upper contour or profile of the control lever 14 in its idle position 14'. Due to the gooseneck shape of the control lever 14, the reed stay 19 in its position 19' conforms or fits closely without undue waste of space to the upper edge or profile of the control lever 14 in its position 14'.

While, during the simple pivoting motion of the control lever 14 into its position 14', each actuating system 16 with its actuation lever 25 is retracted out of the path of the control lever 14 so that the latter is not hampered, the guide strip 30 might nevertheless still be in the way of the pivoting motion. Therefore, clearances may be provided in the guide strip 30 allowing passage of the free end of the control lever 14. FIG. 2 shows such clearances in the guide strip 30 by reference numeral 35. The pivoting positions of the control lever 14 are indicated in dash-dot lines and the control lever 14 passes through the clearances 35.

A constrained-control eccentric or cam system 24 is provided to control the motion of the control lever 14. FIG. 2 shows a mutually complementary cam wheel or disk pair 28 mounted on the block or blocks 12. The actuating motions of the control lever 14 generated by the mutually complementary cam profiles of the cam wheel pair 28 and its pivoting motion from the operational into the rest or idle position 14' are transmitted by a rocking lever or double-lever rocker arm 23 and a driver lever arm 31 thereof via a connecting rod or link 22 to the control lever 14. The rocking lever 23 pivots about an axis disposed substantially parallel to the surface of the crossbeam 3, that is to the base or seat of the block 12, and can be pivoted about a pin or journal 33.

Two lever arms 21 and 21' of the rocking lever 23 engage, by means of sensor or cam follower rolls 27 or the like, the mutually complementary profiles of the cam wheel pair 28, whereas the third driver lever arm 31 or equivalent means is connected in an articulated manner with the connecting rod 22. The control lever 14 is provided with a lever arm 20, or at least an articulation point equivalent to such a lever arm, to connect with the connecting rod 22. The axes of rotation of the link points or articulations at the ends of the connecting rod 22, that is, on the one hand, to the lever arm 20 of the control lever 14 and, on the other hand, to the driver lever arm 31 of the rocking lever 23, extend substantially parallel.

It will be seen in FIG. 2 that a pivot bearing 26 for the control lever 14 and a pivot bearing 32 for the rocker arm or rocking lever 23 are stationarily and individually journalled on the blocks 12. In such FIG. 2, the pivot bearing 26 is mounted substantially vertically above the pivot bearing 32. The control shaft 11 is journalled in other support means according to this figure, but it will be understood that such control shaft 11 could equally well be journalled in rotary bearing means mounted in the enlarged blocks 12. In FIG. 2, the control shaft 11 is mounted substantially vertically below the pivot bearing 26 and the pivot bearing 32. The mutually complementary cam wheel pair 28 and the actuation means comprising the rocking lever 23, the sensor or cam follower rolls 27 and the rocking or pivot pin 33 conjointly constitute a constrained-control cam system 24 separate from the control lever 14 and its pivot bearing 26. This constrained-control cam system 24 drives or actuates the control lever 14 through the linkage means or connecting rod 22 for effecting the control motion defined by the mutually complementary cam profiles of the cam wheel pair 28.

Furthermore it will be appreciated that the crossbeam 3 could equally well be turned clockwise 90° in relation to FIG. 2 and arranged beneath the constrained control cam system 24. In this case, the control shaft 11 could also be mounted to the right of the pivot bearing 26 and the rocker means 33 could be arranged at a location substantially horizontally intermediate therebetween.

Two control levers 14 are provided in FIG. 1 approximately at the center of the weaving machine, each being mounted on separate and displaceable blocks 12. This makes possible precise adjustment both for the donor gripper 6 introduced from the left and for the acceptor gripper 6' introduced from the right, and a separate, finely time-stepped control of the two grippers 6 and 6'. The control levers 14 themselves are mounted in the space between two mutually adjoining arms connecting the reed stay 19 to the sley shaft 8. As already mentioned above, the control shaft 11 serves the devices needed for filling insertion, for instance for yarn tendering and yarn pick-up outside of the shed, and also to control the two control levers 14 within the shed. Where called for, further control levers and cams may be provided for the control shaft 11 and may be mounted on the side next to the shed or to the reed, to there control the pick-up of the filling-yarn tendered by the donor device 13 by means of the left donor gripper 6 or the release of the completely drawn-through filling-yarn from the right acceptor gripper 6'.

It will be obvious to those skilled in the art that many modifications may be made within the scope of the present invention without departing from the spirit thereof, and the invention includes all such modifications.

While there are shown and described present preferred embodiments of the invention, it is to be distinctly understood that the invention is not limited thereto, but may be otherwise variously embodied and practiced within the scope of the following claims.

Accordingly, what I claim is:

1. In an apparatus employed in a shuttleless weaving machine wherein filling-yarn is inserted by gripper systems which are bilaterally advanced into the shed and then retracted and which are provided with clamping means for the filling-yarn, for constrained actuation of the clamping means by control levers controlled by cam means and entering through the warp threads of the shed from the exterior, the improvement which comprises:

pivot means defining a pivot axis for pivotably mounting said control levers at a fixed location below a path of travel of a fabric being woven in the weaving machine;

a control shaft extending beneath said path of travel of said fabric and substantially parallel to said pivot axis;

said cam means comprising at least one mutually complementary cam wheel pair mounted on said control shaft in driven relationship thereto;

actuation means comprising at least one double-lever rocker arm, sensing rolls cooperating therewith for operatively following said cam means, and rocking means defining a rocking axis extending substantially parallel to said control shaft for pivotably mounting said at least one double-lever rocker arm;

said cam means and said actuating means conjointly defining a constrained-control cam system; and linkage means operatively connecting said control levers with said actuation means for pivoting said control levers out of an operative position entering said shed into an idle position beneath a path of motion of a reed stay of a reed of the weaving machine.

2. The improvement as defined in claim 1, wherein:

said rocking means for pivotably mounting said at least one rocker arm is mounted at a location substantially intermediate said pivot means and said control shaft.

3. The improvement as defined in claim 1, wherein:

each said control lever incorporates lever arm means cooperating with said actuation means via said linkage means for actuating each said control lever.

4. The improvement as defined in claim 1, further including:

a groove provided in a cross-beam of the weaving machine;

block means displaceably mounted within said groove; and means for mounting said control levers on said block means.

5. The improvement as defined in claim 4, wherein:

said means for mounting said control levers comprises journal means;

said pivot means for said control levers comprises pivot bearings; and said pivot bearings being journalled on said journal means.

6. The improvement as defined in claim 1, further including:

a guide surface provided on said reed stay; and said guide surface having clearances permitting said control levers to move between said operative position and said idle position thereof.

7. The improvement as defined in claim 1, wherein:

said reed stay has a lower profile which passes above said control levers during beat-up of the inserted filling-yarn;

each said control lever having a bearing region and an upper profile; and each said control lever being bent upwardly in substantially goose-neck shape from said bearing region such that said upper profile of said control lever essentially conforms to said lower profile of said reed stay when said control lever is in said idle position.

8. The improvement as defined in claim 1, wherein:

said actuation means comprises driver lever means for transmitting said control motion to said control levers.

9. The improvement as defined in claim 8, wherein:

said driver lever means is carried by said double-lever rocker arm.

10. The improvement as defined in claim 1, wherein:

said pivot means for said control levers is mounted substantially vertically above said pivot means for said actuating means; and said pivot means for said actuation means is mounted substantially vertically above said control shaft.

* * * * *